US005653198A

United States Patent [19]

Diggs

[11] Patent Number: 5,653,198

[45] Date of Patent: Aug. 5, 1997

[54] FINGER FOLLOWER ROCKER ARM SYSTEM

[75] Inventor: Matthew Bryne Diggs, Farmington, Mich.

[73] Assignee: Ford Motor Company, Dearborn, Mich.

[21] Appl. No.: 586,387

[22] Filed: Jan. 16, 1996

[51] Int. Cl.[6] ..... F01L 13/00; F02D 13/06

[52] U.S. Cl. ..... 123/90.16; 123/90.41; 123/198 F

[58] Field of Search ..... 123/90.15, 90.16, 123/90.27, 90.36, 90.39, 90.41, 90.42, 90.43, 90.44, 90.45, 90.46, 198 F

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 5,524,580 | 6/1996 | Muir | 123/90.16 |
| 5,529,033 | 6/1996 | Hampton | 123/90.16 |
| 5,544,626 | 8/1996 | Diggs et al. | 123/90.16 |

OTHER PUBLICATIONS

Kazuo Inoue, Kenichi Nagahiro, Yoshio Ajiki and Noriyuki Kishi, "A High Power, Wide Torque Range, Efficient Engine with a Newly Developed Variable–Valve–Lift and –Timing Mechanism," pp. 1–12 Mar. 1989.

*Primary Examiner*—Weilun Lo

*Attorney, Agent, or Firm*—Jerome R. Drouillard, Esq; Roger L. May, Esq.

[57] ABSTRACT

A finger follower rocker arm system for an internal combustion engine includes a body having a first end engagable with a valve stem of the internal combustion engine and a second end engagable with a pivot fulcrum of the internal combustion engine, an arm mounted on the body between the first end and second end engagable with a cam lobe of the internal combustion engine, a latch pin disposed within the body and being moveable to engage and disengage the arm, and an actuating mechanism to engage the latch to limit movement of the arm relative to the body to transmit movement of the cam lobe to the body for activating the valve stem and to disengage the latch to allow movement of the arm relative to the body to allow lost motion of the cam lobe relative to the body for de-activating the valve stem.

18 Claims, 5 Drawing Sheets

FIG 3
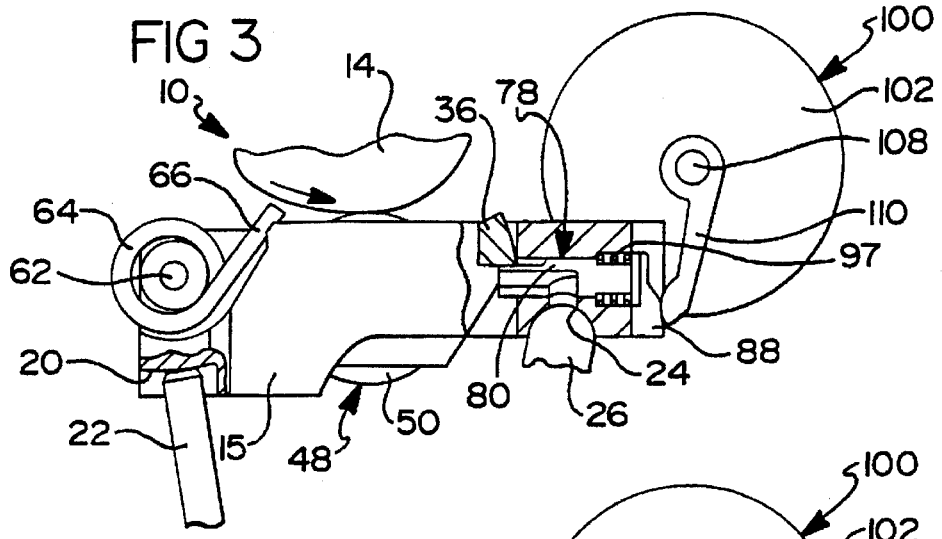
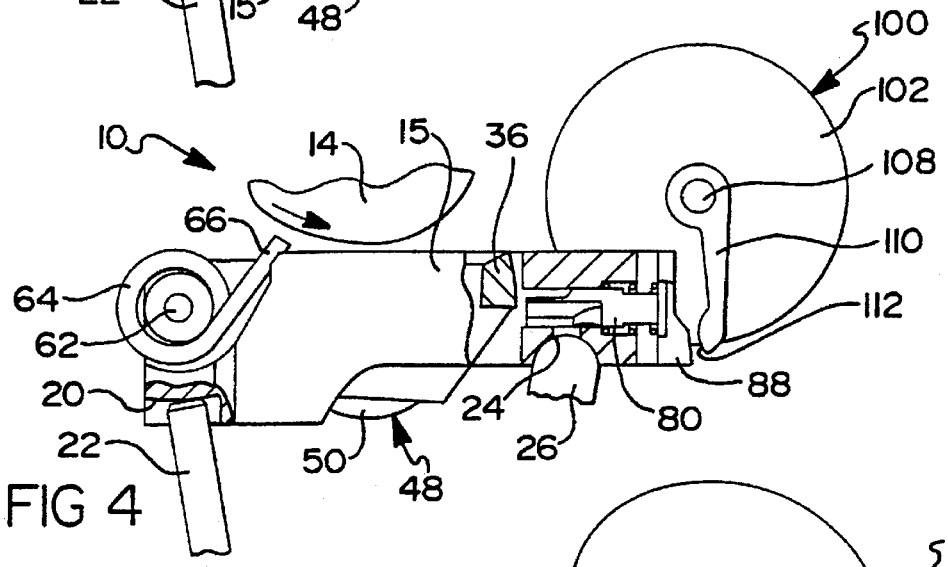
FIG 4
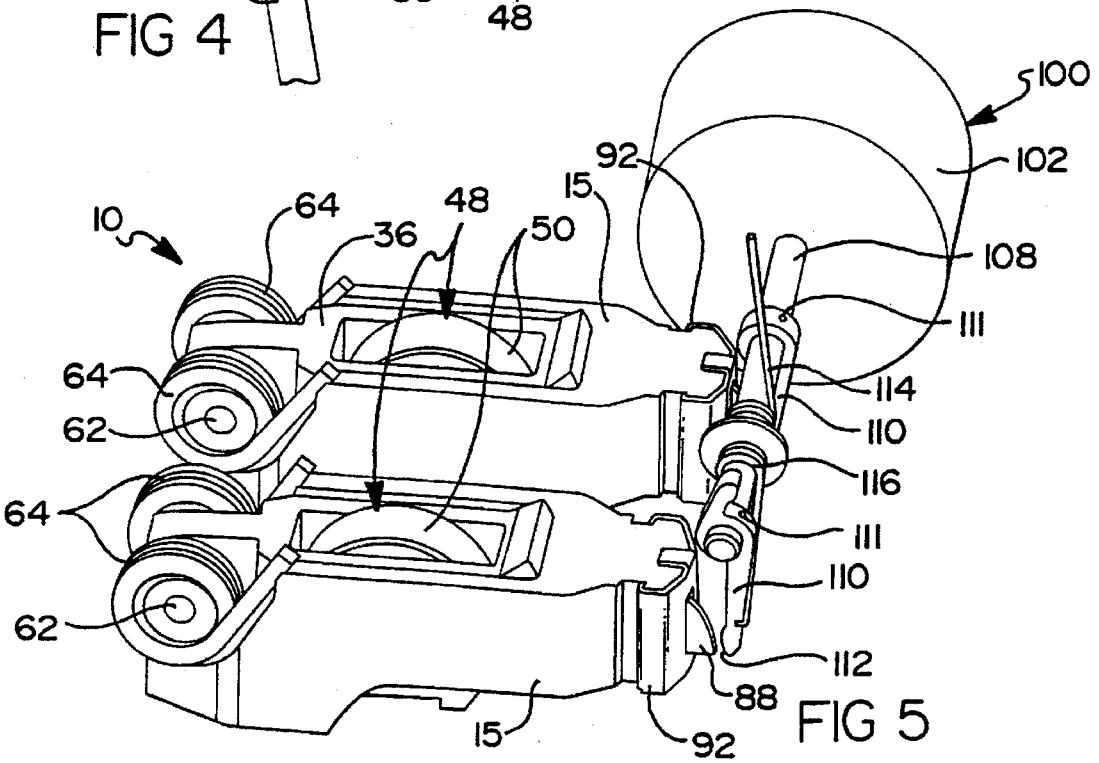
FIG 5

120
122
124
126
E
I
INT. FIRST DE-AC
EXH. FIRST DE-AC
INT. FIRST ACTIVATE
EXH. FIRST ACTIVATE

FINGER FOLLOWER ROCKER ARM SYSTEM

BACKGROUND OF THE INVENTION

1. Field of the Invention

The present invention relates generally to rocker arm systems for internal combustion engines and, more specifically, to a finger follower rocker arm system for an internal combustion engine.

2. Description of the Related Art

It is known to provide a device for deactivating one or more valves for an internal combustion engine during low engine power to provide fuel economy. For example, one known device utilizes a zero lift cam lobe that can be made operative to deactivate a particular valve or valves when desired. Another type of known device utilizes a sliding sleeve assembly and different pad members for selectively deactivating a particular valve. Yet another type of known device utilizes several cams to actuate a number of valves, one cam lobe being higher than others and activated when desired to deactivate the operation of a pair of valves. Still another type of known device utilizes locking pins in cooperation with low and high speed rocker arms in side-by-side relationship to deactivate particular valves.

One disadvantage of the above known devices is that they require specially designed cylinder heads and cannot be substituted for a conventional finger follower rocker arm to provide activation or deactivation of its associated valve as desired. Another disadvantage of these known devices is that they require fluid pressure to be activated and deactivated which can be slow and undesired.

SUMMARY OF THE INVENTION

Accordingly, the present invention is a finger follower rocker arm system for an internal combustion engine. The finger follower rocker arm system includes a body having a first end engagable with a valve stem of the internal combustion engine and a second end engagable with a pivot fulcrum of the internal combustion engine. The finger follower rocker arm assembly also includes an arm mounted on the body between the first end and second end engagable with a cam lobe of the internal combustion engine and a latch pin disposed within the body and being moveable to engage and disengage the arm. The finger follower rocker arm system further includes an actuating mechanism to engage the latch pin to limit movement of the arm relative to the body to transmit movement of the cam lobe to the body for activating the valve stem and to disengage the latch to allow movement of the arm relative to the body to allow lost motion of the cam lobe relative to the body for deactivating the valve stem.

One advantage of the present invention is that a finger follower rocker arm system is provided for an internal combustion engine. Another advantage of the present invention is that the finger follower rocker arm. system is a self-contained drop-in replacement for a conventional finger follower rocker arm to provide activation and deactivation of its associated engine valve as desired. Yet another advantage of the present invention is that the finger follower rocker arm system has a solenoid actuating mechanism which provides fast, accurate actuation of the finger follower rocker arm. Still another advantage of the present invention is that the solenoid actuating mechanism has a low energy consumption. A further advantage of the present invention is that the solenoid actuating mechanism has low package requirements and cost.

Other features and advantages of the present invention will be readily appreciated as the same becomes better understood after reading the subsequent description taken in conjunction with the accompanying drawings.

BRIEF DESCRIPTION OF THE DRAWINGS

FIG. 3 is a fragmentary elevational view of the finger follower rocker arm system of FIG. 1 illustrated in an activated mode.

FIG. 4 is a view similar to FIG. 3 illustrating the finger follower rocker arm system of FIG. 1 in a deactivated mode.

FIG. 5 is a perspective view of another embodiment of the finger follower rocker arm system of FIG. 1.

DESCRIPTION OF THE PREFERRED EMBODIMENT(S)

Figure 1:
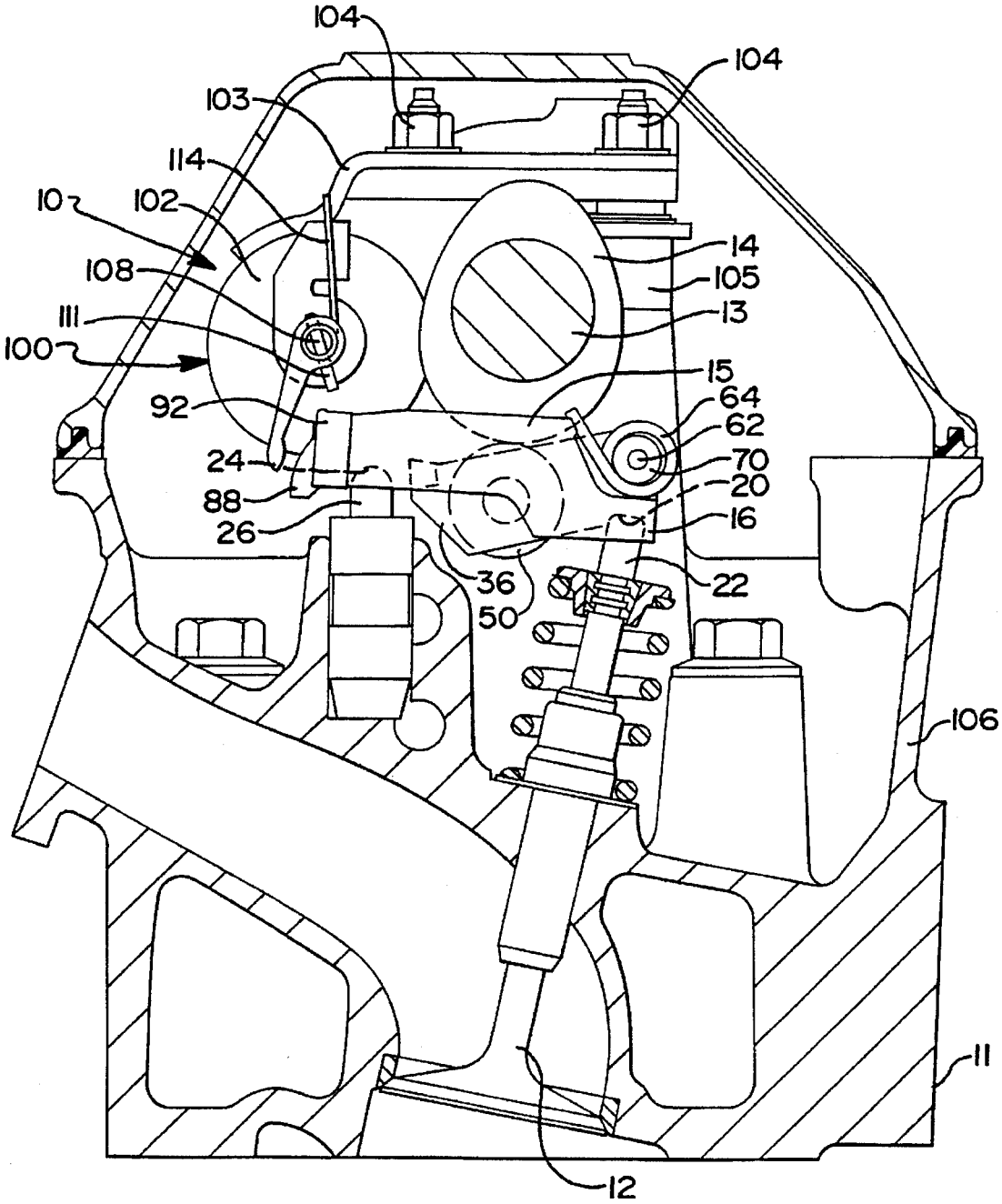
FIG. 1 is a fragmentary elevational view of one embodiment of a finger follower rocker arm system, according to the present invention, illustrated in operational relationship with an internal combustion engine.

Referring to FIG. 1, a finger follower rocker arm system 10, according to the present invention, is illustrated in operational relationship with an internal combustion engine 11 for a vehicle such as an automotive vehicle (not shown). The engine 11 has a plurality of valves 12 for opening and closing intake and exhaust passages of cylinders (not shown). The engine 11 also has a camshaft 13 with a plurality of cam lobes 14. The finger follower rocker arm system 10 cooperates with the cam lobes 14 and valves 12. It should be appreciated that the finger follower rocker arm system 10 is used for interrupting the operation of one or more valves 12 of the internal combustion engine 11 without interfering with normal operation of other valves 12.

Figure 2:
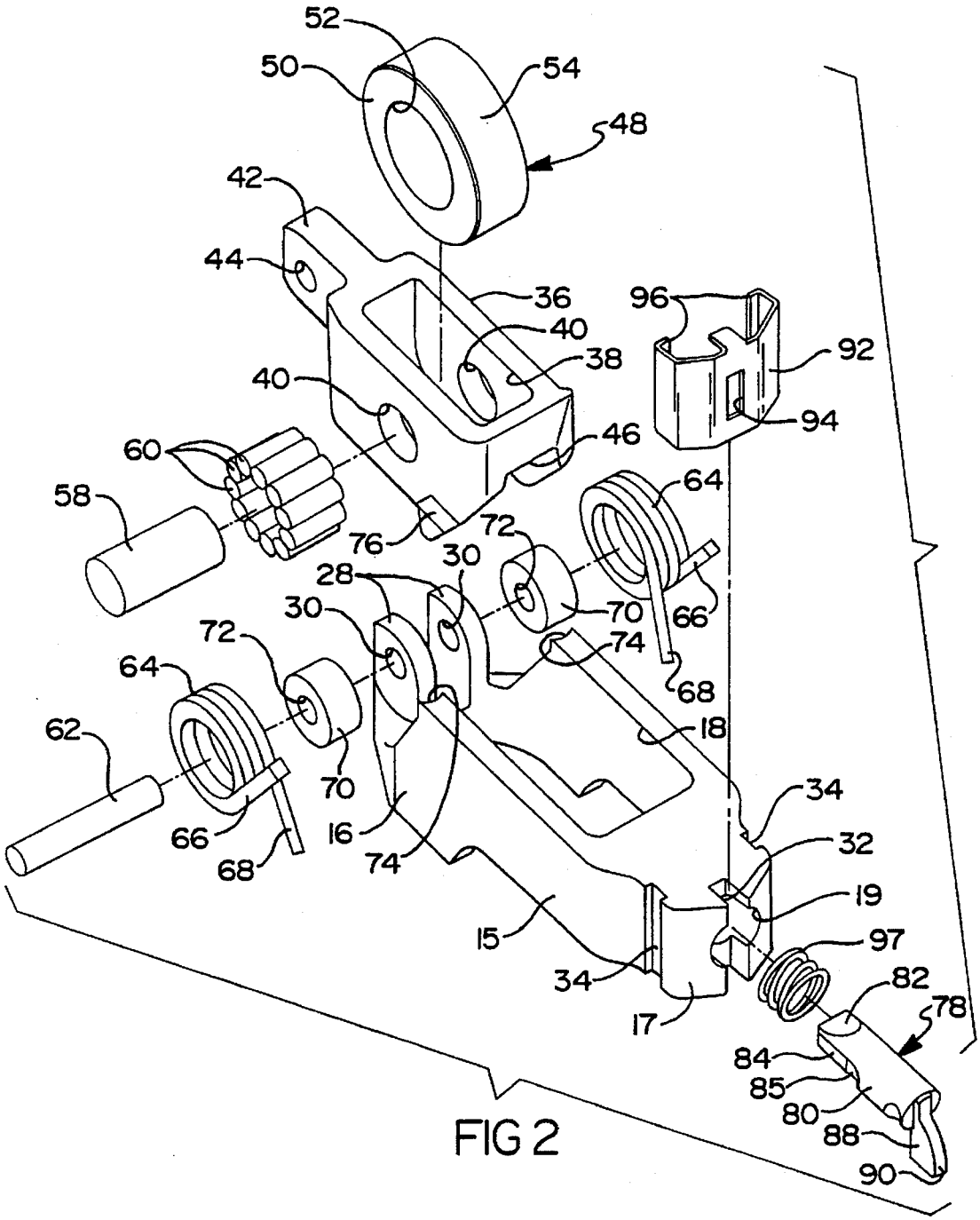
FIG. 2 is an exploded view of a portion of the finger follower rocker arm system of FIG. 1.

Referring to FIGS. 1 through 3, the finger follower rocker arm system 10 includes a body 15 extending longitudinally and having a first end 16 and a second end 17. The body 15 has an aperture 18 extending generally perpendicularly therethrough between the first and second ends 16 and 17 and which is generally rectangular in shape. The body 15 also has a passage 19 extending longitudinally from the second end 17 to the aperture 18. The first end 16 has a recess 20 which receives an end portion of a valve stem 22 of the valve 12 for the internal combustion engine 11. The second end 17 has a socket or recess 24 which receives an end portion of a hydraulic lash adjuster 26. It should be appreciated that the hydraulic lash adjuster 26 constitutes a stationary fulcrum for pivotal movement of the body 15.

The body 15 also includes a pair of flanges 28 extending generally perpendicularly from the first end 16. Each flange 28 includes an aperture 30 extending laterally therethrough. The body 15 further includes a slot 32 extending generally perpendicular through the second end 17 and a slot 34 on each side of the second end 17 for a function to be described.

The finger follower rocker arm system 10 also includes an arm 36 disposed or nested in the aperture 18. The arm 36 is generally rectangular in shape and extends longitudinally. The arm 36 has an aperture 38 extending generally perpendicularly therethrough and which is generally rectangular in shape. The arm 36 has a pair of apertures 40 extending laterally therethrough. The arm 36 has a flange 42 extending longitudinally with an aperture 44 extending laterally therethrough. The arm 36 also has a planar surface 46 at its other end for a function to be described. It should be appreciated that the flange 42 is disposed between the flanges 28 of the body 15. It should also be appreciated that the arm 36 is capable of pivotal arcuate movement relative to the body 15.

The finger follower rocker arm system 10 includes a roller assembly, generally indicated at 48, mounted to the arm 36. The roller assembly 48 includes a roller or wheel 50 being circular in shape and having an inner surface 52 and an outer surface 54. The wheel 50 is disposed in the aperture 38 of the arm 36 such that the outer surface 54 is in essentially friction free rolling engagement with the cam lobe 14 fixed on the camshaft 13 of the internal combustion engine 11. The roller assembly 48 also includes a shaft 58 and a plurality of rollers or needles 60 disposed between the shaft 58 and the inner surface 52 of the wheel 50 for allowing the wheel 50 to rotate about the shaft 58. The shaft 58 extends through the apertures 40 of the arm 36 to mount the wheel 50 to the arm 36.

The finger follower rocker arm system 10 includes a pivot axle or shaft 62 extending through the apertures 30, 44 in the flanges 28, 42 for pivotally mounting the arm 36 to the body 15. The finger follower rocker arm system 10 also includes at least one, preferably a pair of helical torsion springs 64 disposed about the pivot axle 62. Each torsion spring 64 has a first end 66 and a second end 68. One torsion spring 64 is disposed on each side of the body 15 about a torsion spring guide bushing 70. The guide bushing 70 is generally circular in shape and has an aperture 72 extending axially through which the pivot axle 62 extends. The first end 66 of each torsion spring 64 is grounded in a groove 74 formed on the side of the body 15. The second end 68 of each torsion spring 64 is positioned along a surface of the arm 36 to urge the arm 36 and wheel 50 upwardly to cause bumper pads or stops 76 on each side at the bottom of the arm 36 to bottom against the undersurface of the body 15. The torsion springs 64 are stiff enough to prevent the upward force of the lash adjustor 26 to unseat the arm 36 when the cam lobe 14 is on its base circle. Therefore, the latch pin 80 is free to engage or disengage the arm 36 during its base circle duration. It should be appreciated that the symmetrical arrangement of the springs 64 essentially eliminates any twisting due to inertia forces which occur during the valve motion.

The finger follower rocker arm system 10 also includes a latch pin assembly, generally indicated at 78, to engage and disengage the arm 36. The latch pin assembly 78 includes a latch pin 80 extending longitudinally and being generally circular in cross-sectional shape. The latch pin 80 is disposed in the passage 19 and has a horizontal planar surface 82 at one end for mating engagement with the planar surface 46 of the arm 36. The latch pin 80 has planar side surfaces 84 and a 180° annular groove 85 on its underside which guide fluid flow from the hydraulic lash adjuster 26 out the passage 19 to the wheel 50 and other parts of the valve train of the internal combustion engine 11. The latch pin 80 also has a flange 88 extending axially outwardly with a cylindrical surface 90 for a function to be described. The surface 90 is centered at a pivot point of the recess 24 when the latch pin 80 is engaged. The flange 88 is disposed in the slot 32 to prevent rotation of the latch pin 80 and thereby maintain the planar surfaces 82, 46 properly orientated and aligned.

The latch pin assembly 78 also includes a retainer 92 disposed about the second end 17 of the body 15. The retainer 92 provides a stop and limits movement of the latch pin 80 to approximately two (2.0) millimeters. The retainer 92 also has an aperture 94 extending therethrough through which the flange 88 of the latch pin 80 extends. The retainer 92 also has flanges 96 disposed in the slots 34 to retain the retainer 92 to the body 15. The latch pin assembly 78 further includes a return spring 97 disposed about the latch pin 80 between the retainer 92 and the body 12 to urge the latch pin 80 out of engagement with the arm 36.

Referring to FIGS. 1, 3 and 4, the finger follower rocker arm system 10 also includes an actuating mechanism, generally indicated at 100, to actuate the latch pin 80. The actuating mechanism 100 includes a solenoid 102 fixedly or stationarily mounted by a bracket 103 with fasteners 104 to cam bearing caps 105 of a cylinder head 106 of the internal combustion engine 11. The solenoid 102 is electrically connected to a source of power such as an electronic control unit (ECU) (not shown) programmed to actuate by the ECU. Preferably the solenoid 102 is of a rotary type for high speed actuation due to its low effective mass at the axis of the latch pin 80 and its insensitivity to linear G-loads (accelerations). It should be appreciated that a linear solenoid may be used.

The actuating system 100 also includes an axle or shaft 108 rotatable by the solenoid 102. The actuating mechanism 100 further includes at least one actuating arm 110 disposed about and extending radially from the shaft 108 to engage and disengage the flange 88 of the latch pin 80. The actuating arm 110 is secured to the shaft 108 by a roll pin 111 extending through apertures in the actuating arm 110 and shaft 108. The actuating arm 110 has a contact surface 112 which mates and contacts the cylindrical surface 90 on the flange 88. The actuating mechanism 100 further includes a helical torsion spring 114 disposed about the shaft 108 to urge the actuating arm 110 into engagement with the latch pin 80. The torsion spring 114 insures that the latch pin 80 is fully engaged with the arm 36.

In operation, electrical power is supplied from the ECU to the solenoid 102 which causes the actuating arm 110 to rotate away from the latch pin 80 and causes the torsion spring 114 to coil up as illustrated in FIG. 4. The return spring 97 forces the latch pin 80 to disengage the arm 36 which allows lost motion of the arm 36 relative to the body 15, thus canceling out the valve lift event. It should be appreciated that the ECU can cause de-activating to be intake-first de-activation or exhaust-first deactivation.

When electrical power is cut off or stopped to the solenoid 102, the torque of the torsion spring 114 forces the shaft 108 and actuating arm 110 to rotate toward the latch pin 80 such that the actuating arm 110 engages the flange 88 of the latch pin 80. The torque of the torsion spring 114 is transferred to the latch pin 80 and the latch pin 80 overcomes the force of the return spring 97 and moves the latch pin 80 to engage the arm 36, in effect locking the arm 36 and the body 15 together for movement as an integral unit in a downward pivotal direction about the lash adjuster 26 to open the valve 12. It should be appreciated that the finger follower rocker arm system 10 is in a default ON or activate mode. It should also be appreciated that the finger follower rocker arm system 10 may have the solenoid 102 configured so that the latch pin 80 can be normally disengaged with the arm 36 in a default OFF or deactivated made.

Figure 6:
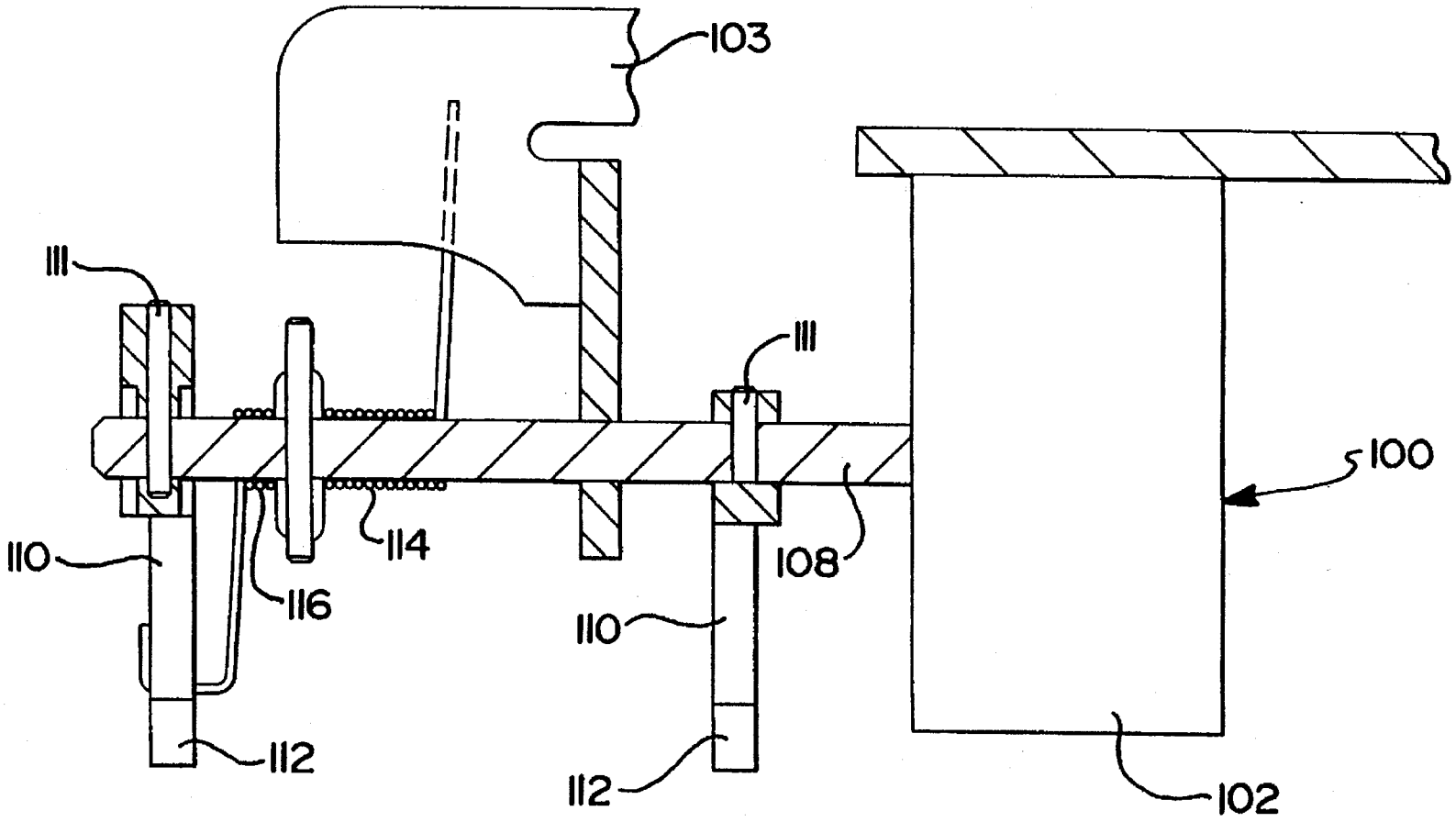
FIG. 6 is a fragmentary plan view of a portion of the finger follower rocker arm system of FIG. 5.

In another embodiment of the finger follower rocker arm system 10, two actuating arms 110 are connected to the shaft 108 to engage two different latch pins 80 as illustrated in FIGS. 5 and 6. The first actuating arm 110 is fixedly secured to the shaft 108 by suitable means such as the roll pin 111 previously described. The second actuating arm 110' is disposed about the shaft 108 and secured to the shaft 108 by the roll pin 111 extending through an oversized aperture in the second actuating arm 110'. The actuating mechanism 100 includes a second torsion spring 116 disposed about the shaft 108 such that the second actuating arm 110' is sprung compliant or relative to the shaft 108 to allow for actuation of multiple followers with a single solenoid. It should be appreciated that the exhaust actuating arm 110' would be sprung compliant.

Figure 7:
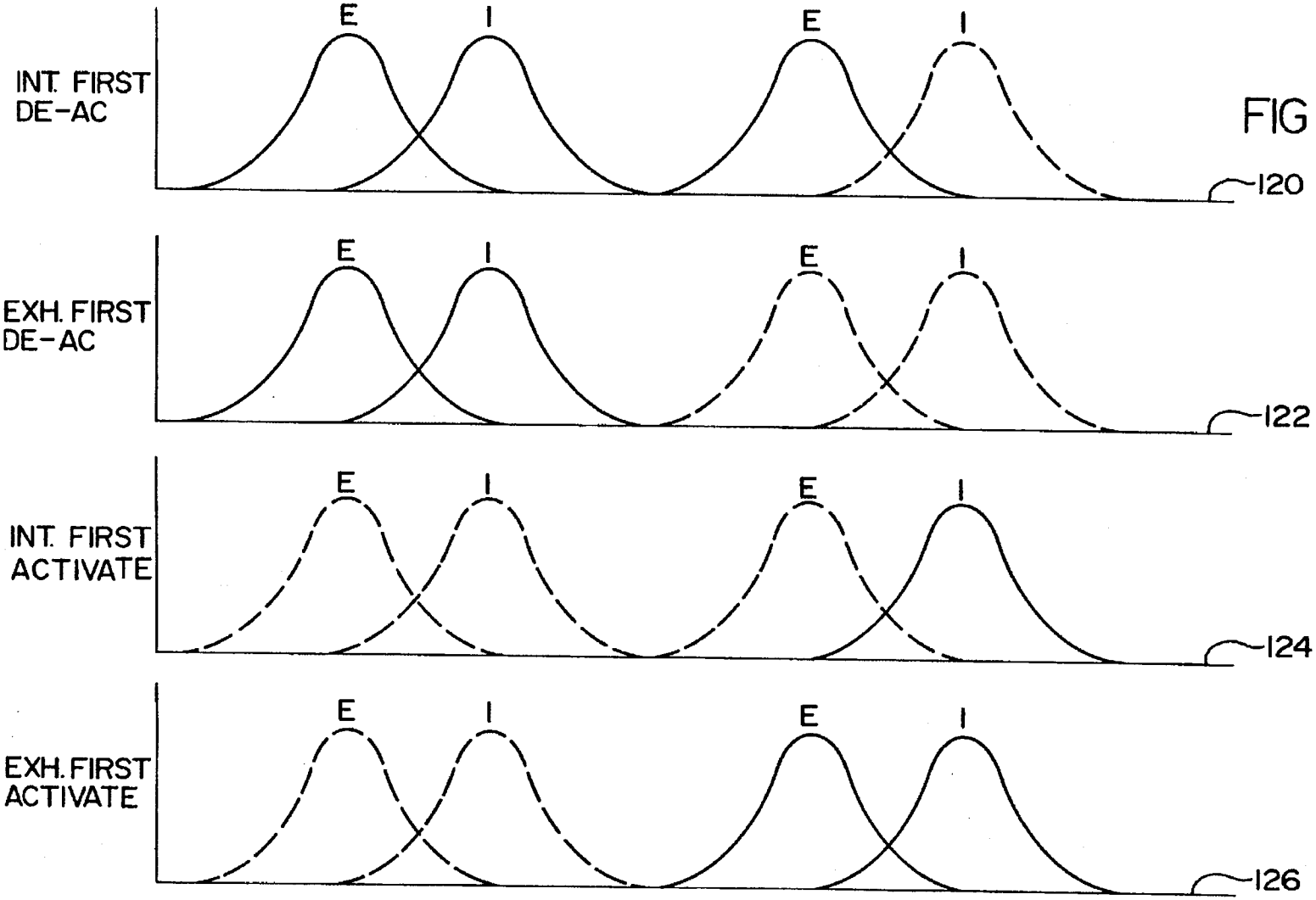
FIG. 7 is a series of graphs illustrating valve events for the finger follower rocker arm system of FIG. 5.

The finger follower rocker arm system 10 allows one solenoid 102 to actuate a pair of latch pins 80 to control both the intake valve and exhaust valve for at least one cylinder of the internal combustion engine 11. As illustrated in FIG. 7, the finger follower rocker arm system 10 allows for four activation/deactivation scenarios: intake first deactivation (valve event cancellation) 120; exhaust first deactivation (valve event cancellation) 122; intake first activation (valve event activate) 124; and exhaust first activation (valve event activate) 126. It should be appreciated that the dotted lines illustrate canceled valve events. It should also be appreciated that the actuating arm 110' for the exhaust valve 12 is sprung compliant to the shaft 108 by the torsion spring 116 to allow either intake first activation or exhaust first activation. It should be appreciated that the second actuating arm 110' is biased forward compared to the actuating arm 110 to ensure that both actuating arms 110 and 110' are fully engaged with the latch pins 80 in the deactivation mode and to compensate for tolerance stack-ups.

During intake first activation 124, the actuating arms 110 and 110' move independently and the actuating arm 110' for the exhaust valve 12, which is compliant sprung, engages the latch pin 80 after the canceled exhaust valve event finishes. During the canceled exhaust event, the latch pin motion is stopped by the cylindrical surface on the arm 36. For intake first deactivation 120, the actuating arms 110 and 110' move together and the latch pin 80 for the exhaust valve 12 disengages when the valve event finishes. During exhaust first activation 126, the actuating arms 110 and 110' move together and the latch pins 80 engage simultaneously. For exhaust first deactivation 122, the actuating arms 110 and 110' move together and the latch pin 80 for the intake valve 12 disengages when the valve event finishes.

Accordingly, the finger follower rocker arm system 10 operates in one mode as a conventional finger follower rocker arm to activate an engine valve in a known manner in response to rotation of the camshaft. The finger follower rocker arm system 10 also operates in another mode to deactivate an engine valve.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A finger follower rocker arm system for an internal combustion engine comprising:

a body having a first end engagable with a valve stem of the internal combustion engine and a second end engagable with a pivot fulcrum of the internal combustion engine;

an arm movably mounted on said body between said first end and said second end engagable with a cam lobe of the internal combustion engine;

a latch pin disposed within said body and being moveable to engage and disengage said arm; and an actuating mechanism to engage said latch pin to limit movement of said arm relative to said body to transmit movement of the cam lobe to said body for activating the valve stem and to disengage said latch pin to allow movement of said arm relative to said body to allow lost motion of the cam lobe relative to said body for deactivating the valve stem; and wherein said actuating mechanism comprises a solenoid, a shaft moveable by said solenoid, and at least one actuating arm disposed about said shaft to engage and disengage said latch pin.

2. A finger follower rocker arm system as set forth in claim 1 wherein said latch pin has a flange extending axially from one end thereof for engagement and disengagement with said at least one actuating arm.

3. A finger follower rocker arm system as set forth in claim 1 including a spring disposed about said shaft to urge said at least one actuating arm into at least one of engagement and disengagement with said latch pin.

4. A finger follower rocker arm system as set forth in claim 1 including a plurality of actuating arms disposed about said shaft.

5. A finger follower rocker arm system as set forth in claim 4 including a spring disposed about said shaft and engaging at least one of said actuating arms to compliant sprung the at least one of said actuating arms relative to said shaft.

6. A finger follower rocker arm system as set forth in claim 1 wherein said body extends longitudinally and has a passage extending longitudinally into said second end of said body, said latch pin being disposed in said passage.

7. A finger follower rocker arm system as set forth in claim 6 including a return spring disposed between said body and said latch pin to urge said latch pin out of engagement with said arm.

8. A finger follower rocker arm system as set forth in claim 6 including a retainer disposed about said second end of said body to limit movement of said latch pin relative to said second end.

9. A finger follower rocker arm system as set forth in claim 2 wherein said body has a slot extending perpendicularly through said second end, said flange being disposed in said slot.

10. A finger follower rocker arm system as set forth in claim 2 wherein said flange has a cylindrical surface to contact said at least one actuating arm.

11. A finger follower rocker arm system for an internal combustion engine comprising:

a plurality of bodies, each of said bodies having a first end engagable with a valve stem of the internal combustion engine and a second end engagable with a pivot fulcrum of the internal combustion engine;

an arm movably mounted on each of said bodies between said first end and said second end engagable with a cam lobe of the internal combustion engine;

a latch pin disposed within each of said bodies and being moveable to engage and disengage said arm; and a solenoid actuating mechanism having a plurality of actuating arms mounted on a shaft rotatable by a solenoid, each of said actuating arms engaging said latch pin of a corresponding one of said bodies to limit movement of said arm relative to said body to transmit movement of the cam lobe to said body for activating the valve stem and to disengage said latch pin to allow movement of said arm relative to said body to allow lost motion of the cam lobe to said body for deactivating the valve stem.

12. A finger follower rocker arm system for an internal combustion engine comprising:

a body having a first end engagable with a valve stem of the internal combustion and a second end engagable with a pivot fulcrum of the internal combustion engine;

an arm movably mounted on said body between said first end and said second end engagable with a cam lobe of the internal combustion engine;

a latch pin disposed within said body and being moveable to engage and disengage said arm; and a solenoid actuating mechanism to engage said latch pin to limit movement of said arm relative to said body to transmit movement of the cam lobe to said body for activating the valve stem and to disengage said latch pin to allow movement of said arm relative to said body to allow lost motion of the cam lobe to said body for deactivating the valve stem; and wherein said solenoid actuating mechanism comprises a solenoid, a shaft rotatable by said solenoid, and at least one actuating arm disposed about said shaft to engage and disengage said latch pin.

13. A finger follower rocker arm system as set forth in claim 12 wherein said latch pin has a flange extending axially from one end thereof for engagement and disengagement with said at least one actuating arm.

14. A finger follower rocker arm system as set forth in claim 12 including a spring disposed about said shaft to urge said at least one actuating arm into engagement with said latch pin.

15. A finger follower rocker arm system as set forth in claim 12 wherein said body extends longitudinally and has a passage extending longitudinally into said second end of said body, said latch pin being disposed in said passage.

16. A finger follower rocker arm system as set forth in claim 12 including a return spring disposed between said body and said latch pin to urge said latch pin out of engagement with said arm.

17. A finger follower rocker arm system as set forth in claim 12 including a retainer disposed about said second end of said body to limit movement of said latch pin relative to said second end.

18. A finger follower rocker arm system as set forth in claim 13 wherein said body has a slot extending perpendicularly through said second end, said flange being disposed in said slot.

* * * * *